US006068355A

United States Patent [19]

Thorp

[11] Patent Number: 6,068,355

[45] Date of Patent: May 30, 2000

[54] PORTABLE WORKSTATION

[75] Inventor: Clarkson S. Thorp, Wayland, Mich.

[73] Assignee: Haworth, Inc., Holland, Mich.

[21] Appl. No.: 09/089,534

[22] Filed: Jun. 3, 1998

[51] Int. Cl.[7] ..... A47B 85/00

[52] U.S. Cl. ..... 312/241; 312/244; 312/351.6; 312/902; 190/11; 248/460; 280/30; 280/37; 108/32; 108/177

[58] Field of Search ..... 312/351.5, 351.6, 312/351.7, 351.8, 351.9, 244, 241, 240, 902, 231, 194, 196, 249.8, 249.11, 223.3, 351.4, 351.11; 190/11; 248/129, 460, 461, 463; 280/30, 37; 108/50.01, 12, 14, 18, 32, 93, 31, 147.2, 147.21, 177

[56] References Cited

U.S. PATENT DOCUMENTS

| | | | |
|---|---|---|---|
| 237,166 | 2/1881 | Burdge | 312/281 |
| 661,194 | 11/1900 | Rothschild et al. | 190/11 |
| 791,506 | 6/1905 | Simmons | 190/11 |
| 1,147,077 | 7/1915 | Collier | 312/300 X |
| 2,943,733 | 7/1960 | Poeschl et al. | 312/224 X |
| 3,408,126 | 10/1968 | Mortensen | 312/244 X |
| 3,709,159 | 1/1973 | Oglesby, Jr. | 108/44 |
| 4,149,763 | 4/1979 | Delahaie | 312/231 |
| 4,813,521 | 3/1989 | Goldstone | 312/244 X |
| 4,934,549 | 6/1990 | Allen | 190/11 X |
| 4,966,258 | 10/1990 | Hawley | 312/240 X |
| 5,395,166 | 3/1995 | Watson | 312/244 |
| 5,680,914 | 10/1997 | Reiser | 190/11 |

FOREIGN PATENT DOCUMENTS

| | | | |
|---|---|---|---|
| 290159 | 10/1928 | United Kingdom | 108/149 |

*Primary Examiner*—Janet M. Wilkens
*Attorney, Agent, or Firm*—Flynn, Thiel, Boutell & Tanis, P.C.

[57] ABSTRACT

A portable workstation or office foldable into a transportable unit including top and bottom parts hingedly connected to one another so that the top part is pivotable with respect to the bottom part between open and closed positions. A table top is disposed atop the bottom part and defines an upwardly facing work surface. The table top and bottom part together define an interior compartment for storing objects therein. The top part includes compartments configured for displaying and storing objects such as documents therein, and the workstation is adapted to secure objects on the work surface and adjacent the compartments during transport or storage of the workstation.

13 Claims, 7 Drawing Sheets

PORTABLE WORKSTATION

FIELD OF THE INVENTION

This invention relates to a self-contained portable workstation or office and, more specifically, to a portable workstation which is foldable into a transportable unit and adapted to fixedly secure work items therein during transport.

BACKGROUND OF THE INVENTION

The typical office environment is centralized in a large office space which is divided into the necessary number of offices by fixed or movable walls. However, with the increasing use of computers, modems, facsimile machines, cellular communications and other technological advances, businesses are more mobile and flexible as they geographically expand their markets. With this increase in mobility and flexibility comes an increase in the amount of work being done outside of the centralized office, which work instead is being done, for example, in remote locations while travelling, in offices at home, or in small decentralized offices associated with a larger main office. Accordingly, a need exists for a portable workstation which is easily transportable, is readily storable when not in use, and can be easily opened to define a reasonably equipped workstation.

This increased demand for mobility and flexibility in conducting business has thus created a need for a small workstation which can be easily set up or broken down, and safely and easily transported.

SUMMARY OF THE INVENTION

It is an object of the present invention to provide a portable workstation which is relatively compact and collapsible so as to be readily transportable and equipped to provide a work area at virtually any location. More particularly, the invention includes a portable workstation having top and bottom parts hingedly connected to one another at edge portions thereof so that the top part is swingably movable between open and closed positions. In addition, a table top is located atop the bottom part and defines an upwardly facing work surface. The table top and bottom part together define an interior compartment for storing objects therein. The top part includes compartments configured for displaying and storing objects such as documents. The portable workstation is adapted to secure objects on the work surface and adjacent the compartments of the top part so that work in progress can be left as is and later returned to, even if the workstation is taken down and stored or transported to another location.

Other objects and purposes of the invention will be apparent to persons familiar with arrangements of this general type upon reading the following specification and inspecting he accompanying drawings.

Figure 1:
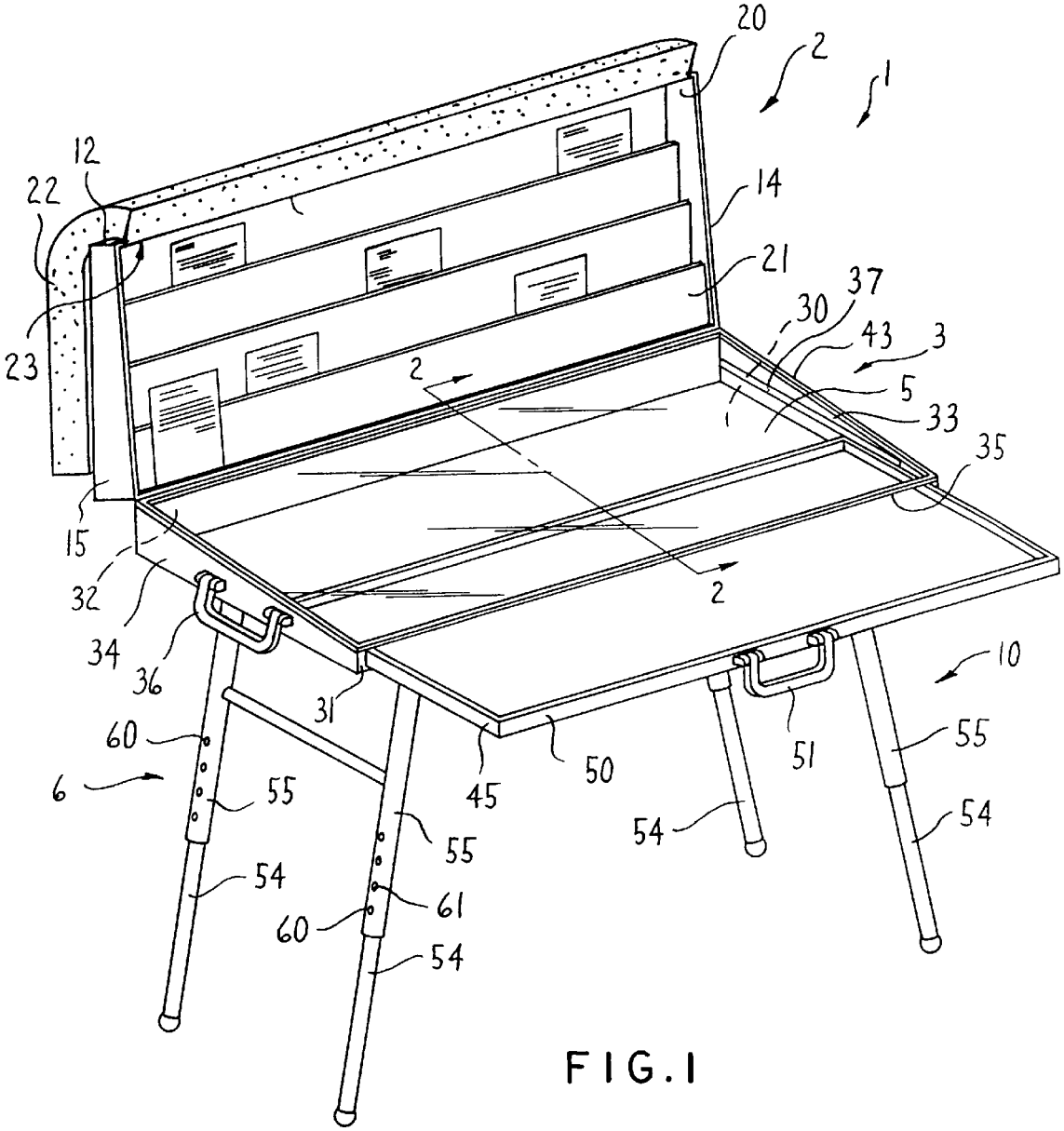
FIG. 1 is a perspective view of a portable workstation according to the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the workstation and designated parts thereof. Said terminology will include the words specifically mentioned, derivatives thereof, and words of similar import.

DETAILED DESCRIPTION

FIGS. 1–7 illustrate a portable workstation 1 according to the invention. FIG. 1 illustrates the portable workstation 1 in an open configuration for use as an office, and FIGS. 4–7 illustrate the portable workstation 1 in a closed, transportable configuration. It will be appreciated that the open workstation 1 shown in FIG. 1 is devoid of necessary working equipment such as a computer, lighting or other office equipment and fixtures, such additional equipment being eliminated from the drawing for clarity of illustration.

The portable workstation 1 includes a top box-like housing part 2 and a bottom box-like housing part 3 fastened to one another by hinges 4 such that the top part 2 is swingably or pivotally movable with respect to the bottom part 3 between an open working position (FIG. 1) and a closed position (FIGS. 3–7). When in the closed position, the adjacent and opposed housing parts 2 and 3 define a generally hollow six-sided box or container which, in transverse cross section, resembles a trapezoid having a back height which is substantially greater than the front height. A table top 5 is disposed atop the bottom part 3 so as to define an upwardly facing work surface. Two pairs of support legs 6 and 10 are pivotably mounted to the bottom part 3 so that the workstation 1 is generally horizontally supportable above a surface such as a floor and therefore usable with a chair (not shown) when the workstation is in an open assembled condition.

The top part 2 is embodied by a generally rectangular, planar panel 11 and four planar side panels including parallel front and rear side panels 12 and 13, and two parallel wedged-shaped side panels 14 and 15, which together define an interior compartment 20 adjacent the table top 5. A three-tiered sorter or article support 21 is fixedly fastened (for example with adhesive, rivets or other suitable fasteners) to an inwardly facing surface of the panel 11 inside the interior compartment 20. The sorter 21 defines therein three longitudinally extending pockets for displaying and/or storing items such as documents therein. Documents can also be stored or displayed in front of the lowermost pocket so as to rest upon an inwardly facing surface of rear side panel 13. The sorter 21 can be of opaque material or alternatively may be constructed of a transparent material, such as PLEXIGLAS®, so that the documents stored therein are visible to the user.

A retaining member or sheet 22 is preferably fixedly attached, for example by adhesive or other suitable fastener, to an inner surface of the front side panel 12 of top part 2 adjacent the free edge 23 thereof. The sheet 22 is preferably made of a resilient and flexible foam, which will easily compress when squeezed and thereafter regain its shape. The sheet 22 serves to secure items located on the table top 5 and in or adjacent the sorter 21 as discussed below.

Figure 3:
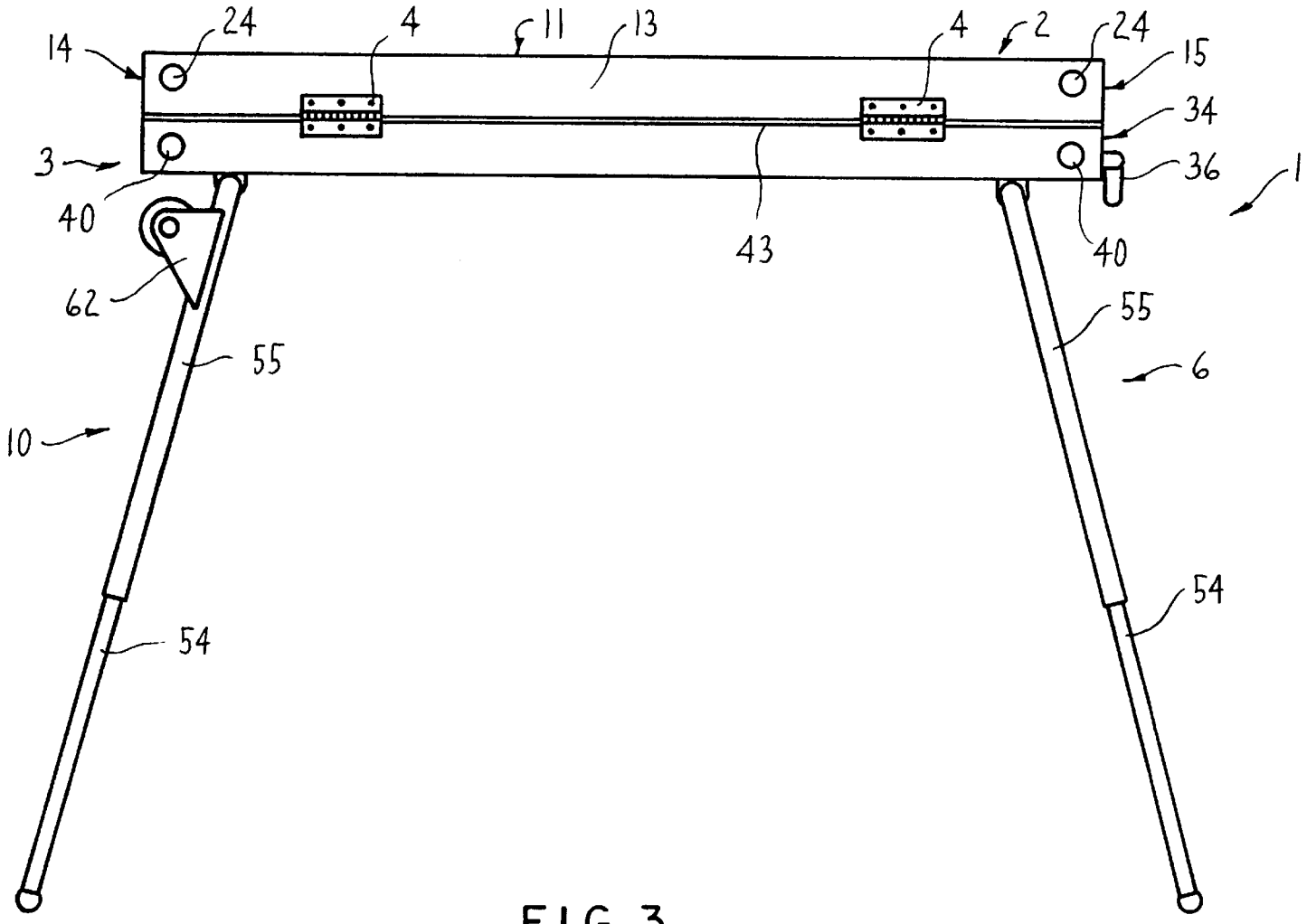
FIG. 3 is a rear view thereof with the top part in the closed position.
Figure 4:
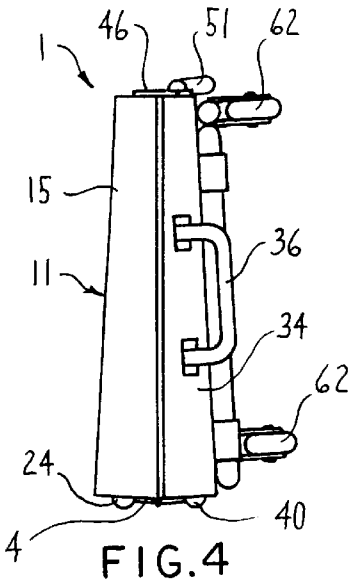
FIG. 4 is a side view illustrating the closed configuration thereof.

Feet 24 are mounted on an outwardly facing surface of the rear side panel 13 of top part 2 at opposite ends thereof, as best shown in FIGS. 3 and 4.

Figure 2:
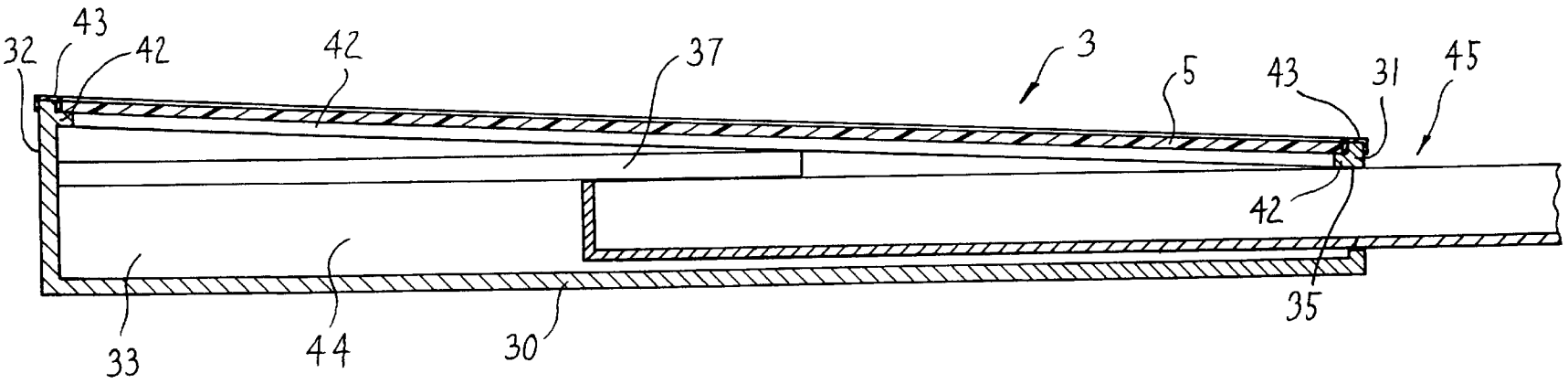
FIG. 2 is a substantially central cross-sectional view thereof along line 2—2 of FIG. 1.

The bottom part 3 includes a generally rectangular, planar bottom panel 30 and four planar side panels including parallel front and rear side panels 31 and 32 and two parallel, generally wedge-shaped side panels 33 and 34. The front side panel 31 preferably has an elongated rectangular slot 35 disposed therein (FIG. 2). Further, feet 40 are provided on an outwardly facing surface of the rear side panel 32 at opposite ends thereof (FIGS. 3 and 4). The larger edges of the wedge-shaped side panels 33 and 34 are respectively located adjacent the larger edges of the wedge-shaped side panels 14 and 15 of the top part 2 to provide the portable workstation 1 with a cross section which is wedge-shaped when closed as shown in FIG. 4. The trapezoidal shape of the portable workstation 1 provides the workstation 1 with overall stability when in the closed position as shown in FIG. 4. A handle 36 is centrally provided on side panel 34.

The top and bottom parts 2 and 3 are preferably constructed of aluminum. Further, the top and bottom parts 2 and 3 may be formed from a single pre-cut metal sheet by folding side portions thereof so as to form the various side panels, or alternatively the various panels of each of the top and bottom parts 2 and 3 may be cut separately and connected to one another by welding.

With reference to FIG. 2, the table top 5 is defined by an enlarged plate-like member which is preferably supported on a shoulder 42 of bottom part 3 which extends longitudinally along the top portions of the front, rear and side panels 31–34 thereof. The upwardly-facing surface of shoulder 42 is preferably angled so that the table top 5 is flush with the top edges of the front side panel 31, rear side panel 32 and side panels 33 and 34 so as to define an enlarged and planar upper work surface which is inclined upwardly at a small angle relative to the horizontal as it projects from the front toward the rear edge. The trapezoidal shape of the bottom part 3 is thus desirable since this type of configuration inherently provides for the inclined position of the table top 5 which preferably has an angle of about 10°–20°. The top 5 is preferably fixedly secured to the bottom part 3, such as by being adhesively secured to the shoulders 42.

As also shown in FIG. 2, a generally U-shaped plastic or rubber strip 43 is preferably provided along the top edges of the front side panel 31, rear side panel 32 and side panels 33 and 34 to prevent the user from being injured by any sharp edges, and to provide a seal between the top and bottom parts 2 and 3 in the closed position of the top part 2. A similar strip (not shown) may also be provided along the free edges of the front, rear and wedged-shaped side panels 12–15 of top part 2.

The table top 5, bottom panel 30, front and rear side panels 31 and 32, and wedge-shaped side panels 33 and 34 together define an interior compartment 44 (FIG. 2) which opens frontwardly at the slot 35 in the front side panel 31 of bottom part 3. An upwardly-opening box-shaped rectangular drawer 45 for storing objects is slidably disposed within slot 35 for storage within the interior compartment 44. The drawer 45 has a frontwardly facing wall portion 50 which, when disposed in the slot 35, is bordered by front side panel 31 and therewith defines the front of the bottom part 3. A handle 51 is centrally located on the frontwardly facing wall portion 50 for opening and closing the drawer 45, and may also be used to manipulate the portable workstation 1 during transport as discussed below. The drawer is slidably supported by guides 37 (only one of which guides 37 is shown in FIGS. 1 and 2) which are fixed to and extend along the inner surfaces of the side panels 33, 34. The drawer 45 is preferably constructed of metal such as aluminum.

Figure 7:
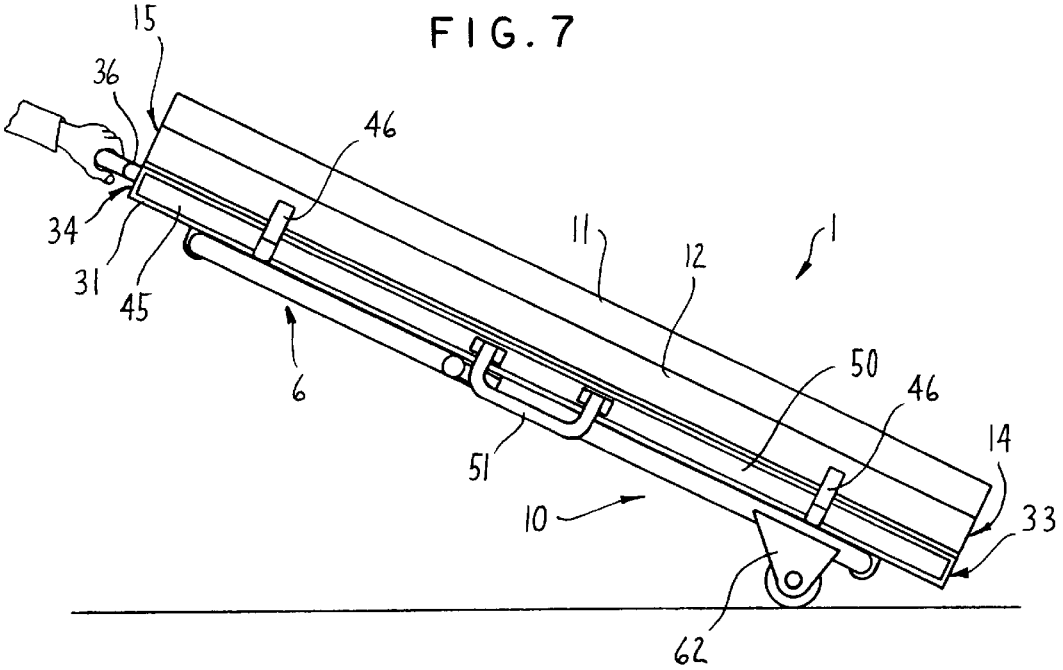
FIG. 7 is a front side view thereof illustrating another mode of transport.

As shown in FIG. 7, two conventional latches 46, such as over-center clasp arrangements, are mounted on the front side panels 12 and 31 of the top and bottom parts 2 and 3, respectively, in order to lock the top and bottom parts 2 and 3 together in a closed position, and also to hold or block the drawer 45 in a closed position inside bottom part 3. In this regard, the clasp arrangements 46 are only one example of clasps which may be utilized with the invention, and other arrangements for locking the top and bottom parts 2 and 3 together and locking drawer 45 inside bottom part 3 may be utilized.

In accordance with a preferred embodiment of the invention, the table top 5 is preferably transparent for easy viewing of the contents stored in drawer 45. In this regard, the table top 5 may be constructed of a transparent sheet-like plastic material such as PLEXIGLAS®.

Figure 6:
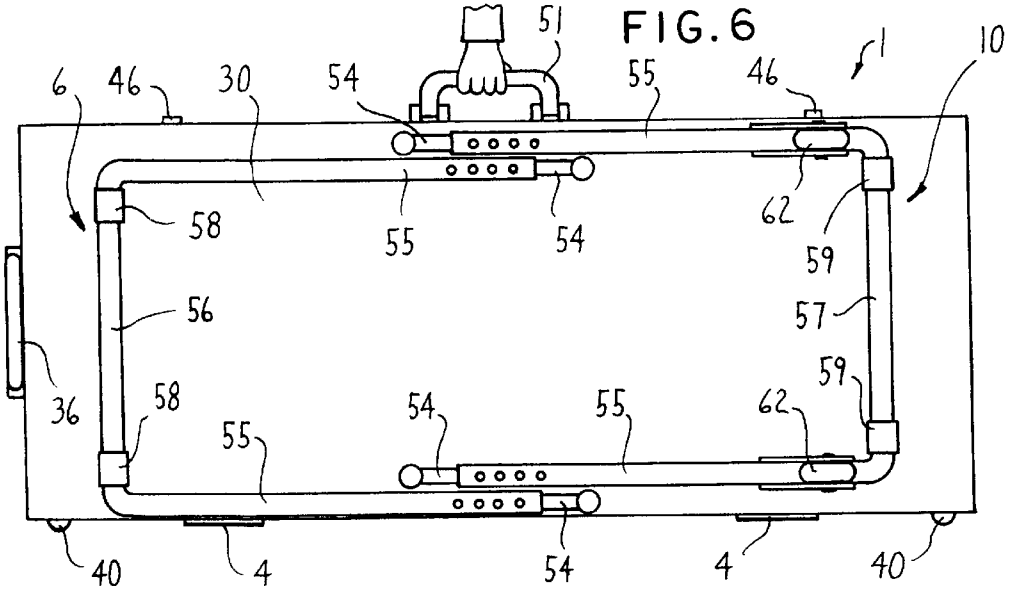
FIG. 6 is a bottom view thereof illustrating one mode of transport.
Figure 5:
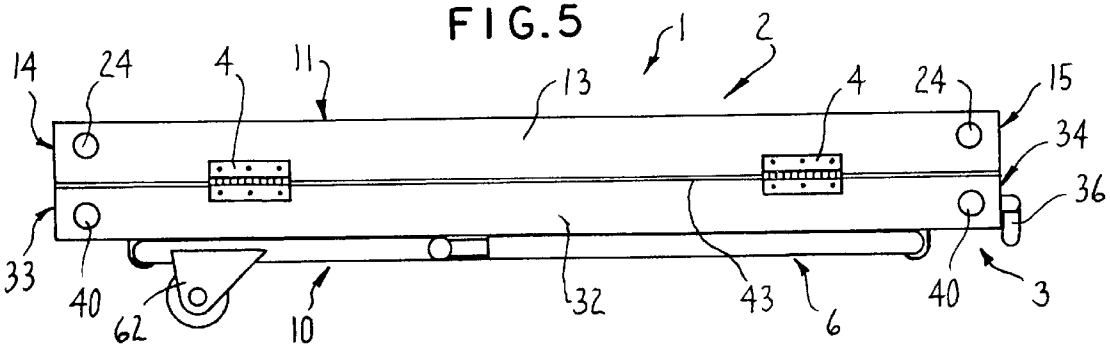
FIG. 5 is a rear view illustrating the closed configuration thereof.

The support leg pairs 6 and 10 are pivotably mounted in a conventional manner on a downwardly facing surface of bottom panel 30 of bottom part 3 adjacent opposite ends thereof (FIG. 6), and are movable into an open position (FIGS. 1 and 3) whereby the portable workstation 1 is supported horizontally above a surface such as a floor, and a folded position (FIGS. 4–7) whereby the support leg pairs 6 and 10 lie closely adjacent the bottom panel 30, for example during storage or transport of the portable workstation 1. As best shown in FIG. 6, the support leg pairs 6 and 10 each include an upper cross-bar 56 and 57 mounted on bottom part 3 by means of hinges 58 and 59, respectively. The hinges 58 and 59 enable the support leg pairs 6 and 10 to swing about a longitudinal axis of each of their respective cross-bars 56 and 57 into the open and folded positions as mentioned above, and also prevent further outward swinging movement of each support leg pair 6 and 10 past the upright positions shown in FIGS. 1 and 3.

The length of each of the individual legs of the support leg pairs 6 and 10 is preferably adjustable so that the user can adjust the height of the portable workstation 1 as desired. The height adjustment of the support leg pairs 6 and 10 can be achieved in any conventional manner, such as by providing a telescoping leg structure including a bottom leg portion 54 which telescopes into a top leg portion 55. Each bottom leg portion 54 preferably has a spring-loaded button 60 which engages with one of a series of vertically disposed orifices 61 in the respective top leg portion 55. The button 60 is pressed inwardly by the user to permit telescoping movement of the bottom leg portion 54 into or out of the respective top leg portion 55 until the button 60 reaches the desired orifice 61 and springs outwardly so that the button 60 engages therein and acts as a vertical stop.

Each of the bottom leg portions 54 is preferably completely collapsible into the respective top leg portion 55, and the support leg pairs 6 and 10 are mounted to the bottom panel 30 in a sidewardly offset manner with respect to one another so that the support leg pairs 6 and 10 do not interfere with one another when in the folded position (FIG. 6).

Other height adjusting mechanisms may also be employed, and the above is provided only as one example of such.

A wheel 62 is preferably mounted on the top leg portion 55 of each leg of the support leg pair 10 disposed at the opposite end of the bottom part 3 from the handle 36. The wheels 62 define a rolling axis which extends transversely in parallel and adjacent relation to the end wall which is remote from the handle 36.

In use, the portable workstation 1 appears as shown in FIG. 1, that is, the top part 2 is in the open position, the sheet 22 is positioned adjacent an outwardly facing surface of panel 11 of the top part 2, and the support leg pairs 6 and 10 are in their upright working positions. When preparing the portable workstation 1 for transport or storage, the sheet 22 is flipped over the top part 2 so as to lie in juxtaposed relation to the sorter 21, and the top part 2 is pivoted downwardly towards bottom part 3 and locked thereto by means of the clasps 46. The sheet 22 is thus compressed between the sorter 21 and the table top 5 so that any materials left on the table top 5 and/or adjacent the sorter 21 are secured and prevented from moving or shifting during transport. The portable workstation 1 is then turned so that feet 24 and 40 are positioned on the support surface or floor as shown in FIG. 4. With the portable workstation 1 in the position shown in FIG. 4, the bottom leg portions 54 of the support leg pairs 6 and 10 are pushed completely into the respective top leg portions 55, and the support leg pairs 6 and 10 are then pivoted towards one another so as to lie against the bottom panel 30 of bottom part 3. With the above arrangement, the portable workstation 1 can be readily set up and taken down without the need for additional tools.

The portable workstation 1 may be transported in several ways. As shown in FIG. 6, the portable workstation 1 can be grasped by the drawer handle 51 and carried like a briefcase. Alternatively, as shown in FIG. 7, the portable workstation 1 can be turned so that the wheels 62 of the support leg pair 10 contact the floor. In accordance with this method of transport, the user grasps the handle 36 located on bottom part 3 and rolls the portable workstation 1 across the floor by means of the wheels 62.

The portable workstation 1 according to the invention preferably has a width of about 18 to 20 inches, and a length of about 42 to 48 inches, and a maximum height of about 4 inches at the front thereof (adjacent handle 51) and about 6 inches at the rear thereof (adjacent hinges 4).

Figure 8:
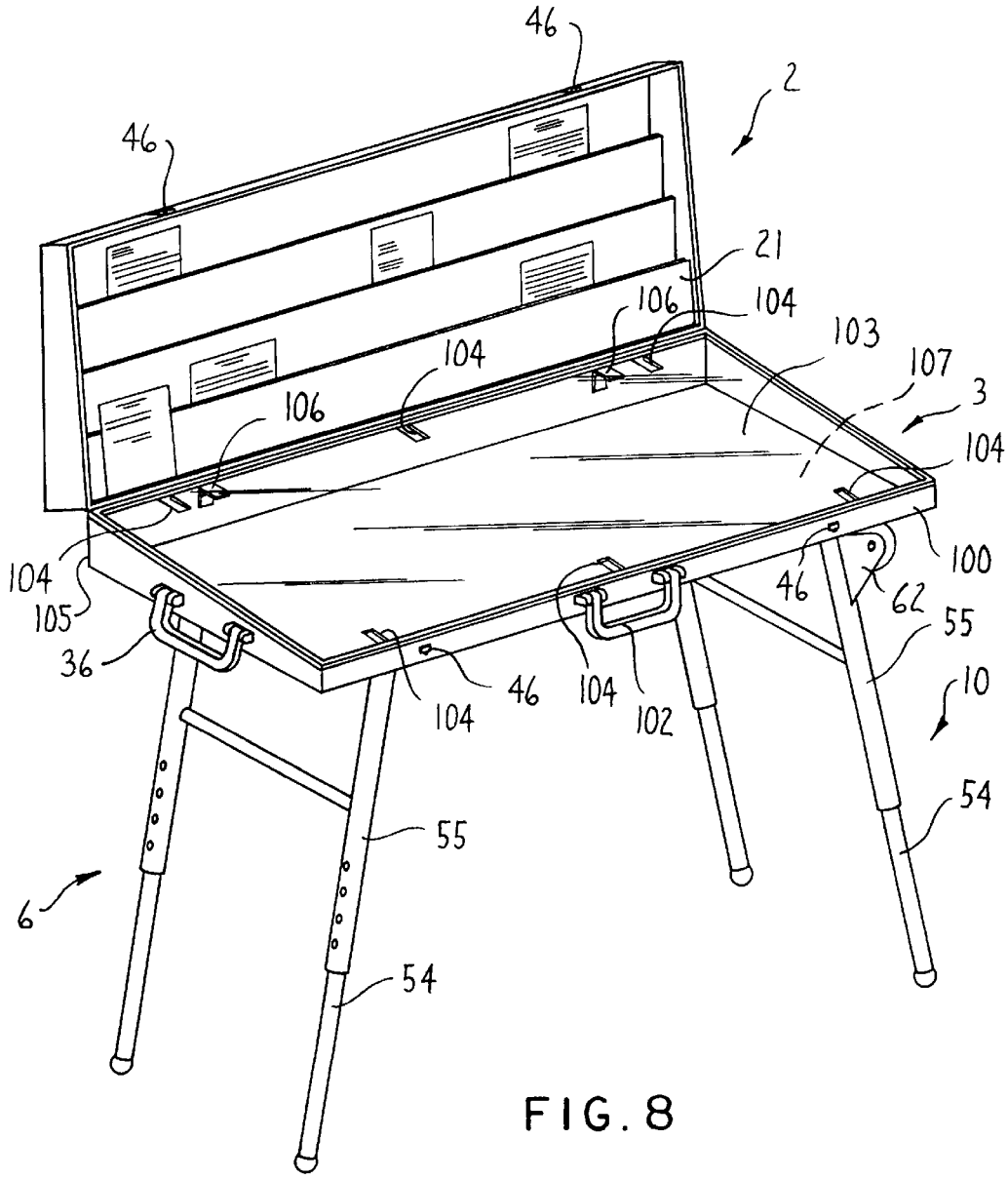
FIG. 8 shows a perspective view of a variation of the portable workstation.
Figure 9:
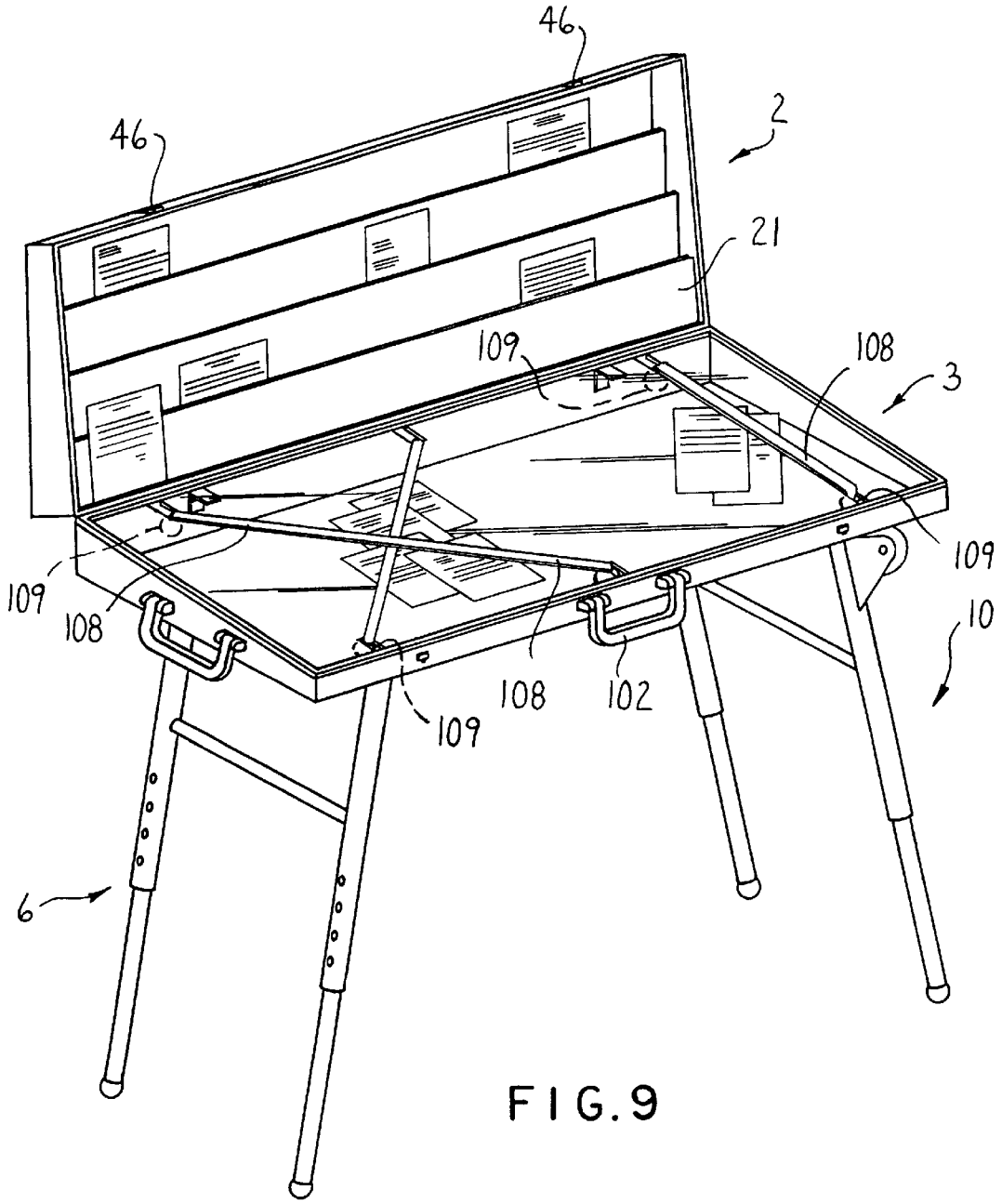
FIG. 9 shows the FIG. 8 variation of the portable workstation with elastic straps for securing items on the work surface.

FIGS. 8 and 9 show a variant of the portable workstation which does not include a drawer 45 or sheet 22. Instead, the portable workstation shown in FIGS. 8 and 9 includes a bottom part with a solid front side panel 100 including a handle 102 mounted centrally thereon, and a table top 103 having a plurality of slots 104 which extend inwardly from the front and rear edges thereof. The rear edge of table top 103 is preferably attached to the rear side panel 105 of the bottom part by hinges 106 so that the table top 103 is pivotable upwardly away from the bottom part to provide access to interior compartment 107 and objects stored therein.

As shown in FIG. 9, elastic straps 108 are provided to secure items atop the table top 103 during transport or storage of the portable workstation. The straps 108 preferably include securing members 109 at each end thereof which are preferably constructed of flexible foam which will easily compress when squeezed and thereafter regain its shape. To secure work items on table top 103, the straps 108 are stretched across table top 103 and secured thereat by squeezing and inserting the securing members 109 into the appropriate slots 104.

The embodiment shown in FIGS. 8 and 9 is otherwise identical to the embodiment shown in FIGS. 1–7.

It should be understood that the table top 103 shown in FIGS. 8 and 9 may alteratively be provided with openings or holes adjacent the outer edges of table top 103 instead of the slots 104.

It should also be understood that various features of the embodiment shown in FIGS. 8 and 9 may be included in the embodiment shown in FIGS. 1–7, and vice versa. For example, the portable workstation of FIGS. 8 and 9 may be provided with a foam sheet 22 along the top part thereof to secure items during transport in addition to the straps 108, or as an alternative to the straps 108.

Although preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A portable workstation comprising:

top and bottom parts hingedly connected to one another at edge portions thereof for swinging movement of said top part with respect to said bottom part between open and closed positions;

a table top disposed on said bottom part defining an upwardly facing work surface, said table top and said bottom part together defining an interior compartment for storing objects therein;

said top part including at least one compartment configured for displaying and storing objects therein; and a resilient and compressible foam sheet pivotably connected along a free edge portion of said top part, said foam sheet being swingable into a position between said top and bottom parts wherein said sheet is compressed between said table top and said top part to secure objects on said work surface and adjacent said compartment in said closed position of said top part during transport or storage of said portable workstation.

2. The portable workstation of claim 1 including a drawer slidably disposed in said interior compartment for storing objects therein and being movable between a closed position wherein said drawer is located under said table top and an open position wherein said drawer extends substantially horizontally outwardly from said bottom part.

3. The portable workstation of claim 1 wherein said able top comprises a transparent material.

4. The portable workstation of claim 1 further including a plurality of collapsible support legs disposed to support said workstation substantially horizontally above a support surface, said support legs being pivotably fastened to said bottom part for movement between an upright position for supporting said portable workstation above the support surface and a folded position wherein said support legs lie closely adjacent said bottom part.

5. The portable workstation of claim 4 wherein said plurality of support legs includes a first pair of support legs disposed adjacent a first end of said bottom part and a second pair of support legs disposed adjacent a second end of said bottom part, each said leg of said first pair of support legs including thereon wheel means for transport of said portable workstation in said folded position of said support legs.

6. The portable workstation of claim 5 wherein said bottom part includes handle means disposed adjacent said second end of said bottom part for manipulating said portable workstation during transport thereof.

7. The portable workstation of claim 1 wherein said position of said sheet between said top and bottom parts is a first position, said top part comprises a generally rectangular panel and four side panels each extending generally perpendicularly from an edge of said rectangular panel to form a box-like shape, a frontwardly disposed one of said side panels comprising said free edge portion and said compartment of said top part being disposed at a first side of said rectangular panel adjacent said table top, said sheet being swingable into a second position in said open position of said top part wherein said sheet is disposed adjacent and in juxtaposed relation to a second side of said rectangular panel opposite said first side.

8. The portable workstation of claim 1 wherein said table top is mounted on said bottom part in a downwardly inclined position relative to a user.

9. The portable workstation of claim 1 including clasp means for locking said top and bottom parts together in said closed position of said top part.

10. The portable workstation of claim 1 wherein:

said bottom part includes a generally rectangular bottom panel, substantially parallel front and rear panels and two substantially parallel side panels, said front panel, said rear panel and said two side panels each extending generally perpendicularly and upwardly from a respective edge of said bottom panel to form a box-like shape, each of said two side panels being generally wedge-shaped and having an enlarged edge; and said top part includes a generally rectangular panel, substantially parallel front and rear panels and two substantially parallel side panels, said front panel, said rear panel and said two side panels of said top part each extending generally perpendicularly from a respective edge of said rectangular panel to form a box-like shape, said rear panel of said top part being hingedly fastened to said rear panel of said bottom part, and each of said two side panels of said top part being generally wedge-shaped and having an enlarged edge disposed adjacent said enlarged edges of said wedge-shaped side panels of said bottom part.

11. The portable workstation of claim 1 wherein said table top is hingedly fastened to said bottom part for pivoting movement of said table top with respect to said bottom part, said table top being pivotable upwardly away from said bottom part to provide access to said interior compartment.

12. A portable workstation comprising:

top and bottom parts hingedly connected to one another at edge portions thereof for swinging movement of said top part with respect to said bottom part between open and closed positions;

a table top disposed on said bottom part defining an upwardly facing work surface, said table top and said bottom part together defining an interior compartment for storing objects therein;

said top part including at least one compartment configured for displaying and storing objects therein; and said table top including a plurality of openings disposed adjacent a peripheral edge thereof and said workstation including at least one elastic strap 1having a resilient and compressible member disposed at each end thereof configured for insertion into a desired one of said openings to secure objects on said work surface in said closed position of said top part during transport or storage of said portable workstation.

13. The portable workstation of claim 12, further including a plurality of collapsible support legs disposed to support said workstation in a substantially horizontal manner above a support surface.

* * * * *

UNITED STATES PATENT AND TRADEMARK OFFICE
CERTIFICATE OF CORRECTION

PATENT NO : 6 068 355
DATED : May 30, 2000
INVENTOR(S) : Clarkson S. THORP

It is certified that error appears in the above-identified patent and that said Letters Patent are hereby corrected as shown below:

Column 6; line 45, change "able" to ---table---.

Column 8; line 23, delete "1".

Signed and Sealed this

Seventeenth Day of April, 2001

*Attest:*

Nicholas P. Godici

NICHOLAS P. GODICI

*Attesting Officer*

*Acting Director of the United States Patent and Trademark Office*